US005623971A

United States Patent [19]

Foernzler

[11] Patent Number: 5,623,971

[45] Date of Patent: Apr. 29, 1997

[54] DRAIN AND CLEANOUT SPACER

[76] Inventor: William E. Foernzler, 306 Grovewood Dr., Beech Grove, Ind. 46107

[21] Appl. No.: 527,338

[22] Filed: Sep. 12, 1995

[51] Int. Cl.[6] ..... F16L 55/00; E04B 1/00

[52] U.S. Cl. ..... 138/89; 138/76 R; 138/104; 52/103; 116/209

[58] Field of Search ..... 138/89, 89.1–89.4, 138/91, 104, 96 R, 96 T; 215/306, 255, 278; 220/375; 4/286, 293; 52/103, 220.1; 116/209

[56] References Cited

U.S. PATENT DOCUMENTS

| | | | |
|---|---|---|---|
| 2,202,147 | 5/1940 | Gerriets | 72/0.5 |
| 2,846,852 | 8/1958 | Cappel | 61/53 |
| 2,976,543 | 3/1961 | Turner et al. | 4/252 |
| 3,013,308 | 12/1961 | Armour | 220/375 |
| 3,113,595 | 12/1963 | Cotman, Jr. | 138/113 |
| 3,126,918 | 3/1964 | Eaton | 138/113 |
| 3,213,889 | 10/1965 | Ctoman, Jr. | 138/113 |
| 3,319,268 | 5/1967 | Blumenkranz | 4/252 |
| 3,349,412 | 10/1967 | Schwartz et al. | 4/252 |
| 3,400,411 | 9/1968 | Harvey | 4/252 |
| 3,421,551 | 1/1969 | Currier | 138/178 |
| 3,528,456 | 9/1970 | Scheffler | 138/113 |
| 3,552,734 | 1/1971 | Severino | 52/99 X |
| 3,568,382 | 3/1971 | Munn | 52/99 |
| 3,800,486 | 4/1974 | Harvey | 52/98 |
| 3,807,744 | 4/1974 | Gibling | 277/207 |
| 3,821,820 | 7/1974 | Thompson | 4/252 |
| 4,052,759 | 10/1977 | Hill | 4/252 |
| 4,260,330 | 4/1981 | Frotschner et al. | 416/180 |
| 4,303,102 | 12/1981 | Hugley | 138/96 |
| 4,432,485 | 2/1984 | Smith | 228/44.1 |
| 4,482,161 | 11/1984 | Izzi, Sr. | 277/207 |
| 4,623,170 | 11/1986 | Cornwall | 285/4 |
| 4,706,841 | 11/1987 | Grajek | 220/375 |
| 4,754,895 | 7/1988 | Lardner et al. | 220/375 X |
| 4,906,496 | 3/1990 | Hosono | 428/36.9 |
| 5,003,735 | 4/1991 | Bates | 116/209 X |
| 5,040,478 | 8/1991 | Hughes | 116/209 |
| 5,071,001 | 12/1991 | Ryman, III | 220/375 X |
| 5,099,887 | 3/1992 | Hooper | 138/89 |
| 5,179,907 | 1/1993 | Galbraith | 116/209 |
| 5,236,166 | 8/1993 | Darling | 52/103 X |

FOREIGN PATENT DOCUMENTS

| | | | |
|---|---|---|---|
| 661591 | 7/1965 | France | 215/255 |

*Primary Examiner*—David Scherbel
*Assistant Examiner*—Patrick F. Brinson
*Attorney, Agent, or Firm*—Woodard, Emhardt, Naughton, Moriarty & McNett

[57] ABSTRACT

A drain and cleanout spacer which facilitates height adjustment of the drain strainer and cleanout port after pouring a concrete slab floor. The device comprises two cup-shaped plastic spacers joined by a flexible web. The first spacer has inside dimensions slightly larger than the outside dimensions of the drain strainer, while the second spacer has inside dimensions slightly larger than the outside dimensions of the cleanout port. The spacers are preferably made from a frangible material, such as plastic. The spacers are placed over the drain strainer and the cleanout port prior to pouring the concrete slab floor. After the concrete has hardened, the tops of the spacers are broken away and the height of the drain strainer and the cleanout port are adjusted to the level of the floor. Thereafter, caulking is applied around the dram strainer and the cleanout port in order to seal them to the floor. A flag is coupled to one of the spacers in order to easily signal the location of the device. This reduces the chance that the device will be inadvertently covered with concrete or stepped on by a worker. Also, a flexible web couples the first and second spacer and provides a downward moment to each spacer which acts to keep the spacers in place when the concrete is poured.

4 Claims, 5 Drawing Sheets

DRAIN AND CLEANOUT SPACER

TECHNICAL FIELD OF THE INVENTION

The present invention relates to an apparatus for use with a floor drain and associated cleanout port and, more specifically, to a drain and cleanout spacer which facilitates height adjustment of the drain and cleanout port after pouring a concrete slab floor.

BACKGROUND OF THE INVENTION

During the construction of a building having a concrete slab floor, it is customary to restall a drain in the floor prior to pouring the concrete. Both the drain strainer and the cleanout port closure threadingly engage the drain pipe unit in order to provide adjustability to the vertical height of the drain strainer and the cleanout port closure. Once the drain pipe unit is coupled to the rest of the building plumbing, the drain strainer and the cleanout port closure may be adjusted to be flush with the height of the finished floor.

Thereafter, when concrete is poured to finish the floor, great care must be taken that concrete is not allowed to flow over the drain strainer, which would clog the drain, or over the cleanout port, which would prevent future access to the cleanout port for servicing the drain. This is obviously difficult to do when pouring a large concrete slab floor. Furthermore, once the concrete surrounding the drain strainer and the cleanout port has hardened, it is no longer possible to adjust the height of the drain strainer or the cleanout port.

Devices are known in the prior art for preventing concrete from flowing up to a drain pipe riser designed to sealingly engage a toilet bowl outlet and associated sealing gasket, both of which are installed after the concrete floor has hardened. For example, U.S. Pat. No. 5,099,887 describes a drain collar formed from an inner sleeve sized to engage the dram pipe riser and a larger outer sleeve coupled to the inner sleeve by a series of webs. After the concrete has been poured and hardened, the webs are broken and the inner sleeve is removed, leaving an annular space around the dram pipe riser for installation of the sealing gasket. Such a device would be inappropriate for keeping concrete away from a drain strainer and cleanout port because the relatively large annular space would have to be later filled, as there is no sealing gasket required around either of the drain strainer or the cleanout port.

There is therefore a need in the prior art for a drain strainer and cleanout port spacer which will keep concrete away from the drain strainer and cleanout port during pouring of a concrete slab, but which will not leave a large annular space therearound. The present invention is directed toward meeting this need.

SUMMARY OF THE INVENTION

The present invention relates to a drain and cleanout spacer which facilitates height adjustment of the drain strainer and cleanout port after pouring a concrete slab floor. The device comprises two cup-shaped plastic spacers joined by a flexible web. The first spacer has inside dimensions slightly larger than the outside dimensions of the drain strainer, while the second spacer has inside dimensions slightly larger than the outside dimensions of the cleanout port. The spacers are preferably made from a frangible material, such as plastic. The spacers are placed over the drain strainer and the cleanout port prior to pouring the concrete slab floor. After the concrete has hardened, the tops of the spacers are broken away and the height of the drain strainer and the cleanout port are adjusted to the level of the floor. Thereafter, caulking is applied around the drain strainer and the cleanout port in order to seal them to the floor. A flag is coupled to one of the spacers in order to easily signal the location of the device. This reduces the chance that the device will be inadvertently covered with concrete or stepped on by a worker. Also, a flexible web couples the first and second spacer and provides a downward moment to each spacer which acts to keep the spacers in place when the concrete is poured.

In one form of the invention, a drain and cleanout spacer is disclosed, comprising a first spacer having a round first top section and a hollow cylindrical first rim section coupled circumferentially to the first top section, wherein the first top section and the first rim section together form a first cylindrical space; a second spacer having a round second top section and a hollow cylindrical second rim section coupled circumferentially to the second top section, wherein the second top section and the second rim section together form a second cylindrical space; and a flexible web coupling the first and second spacers; whereto the first and second spacers are formed from a frangible material.

In another form of the invention, a method of installing a floor drain in a concrete floor is disclosed, comprising the steps of: (a) installing a floor drain at a desired location in the floor, wherein the floor dram includes a drain strainer and a cleanout port closure; (b) providing a first spacer having a round first top section and a hollow cylindrical first rim section coupled circumferentially to the first top section, wherein the first top section and the first rim section together form a first cylindrical space; (c) positioning the first spacer over the drain strainer such that the drain strainer occupies the first cylindrical space; (d) providing a second spacer having a round second top section and a hollow cylindrical second rim section coupled circumferentially to the second top section, wherein the second top section and the second rim section together form a second cylindrical space and wherein the second spacer is joined to the first spacer by a flexible web; (e) positioning the second spacer over the cleanout port closure such that the cleanout port closure occupies the second cylindrical space; (f) pouting a quantity of concrete to form the floor, whereto the concrete contacts the first and second rim sections; (g) allowing the concrete to cure; (h) breaking away the first top section; (i) adjusting a height of the drain strainer; (j) breaking away the second top section; (k) adjusting a height of the cleanout port closure; (l) placing caulking between the dram strainer and the concrete floor; and (m) placing caulking between the cleanout port closure and the concrete floor.

DETAILED DESCRIPTION OF THE PREFERRED EMBODIMENTS

Figure 1:
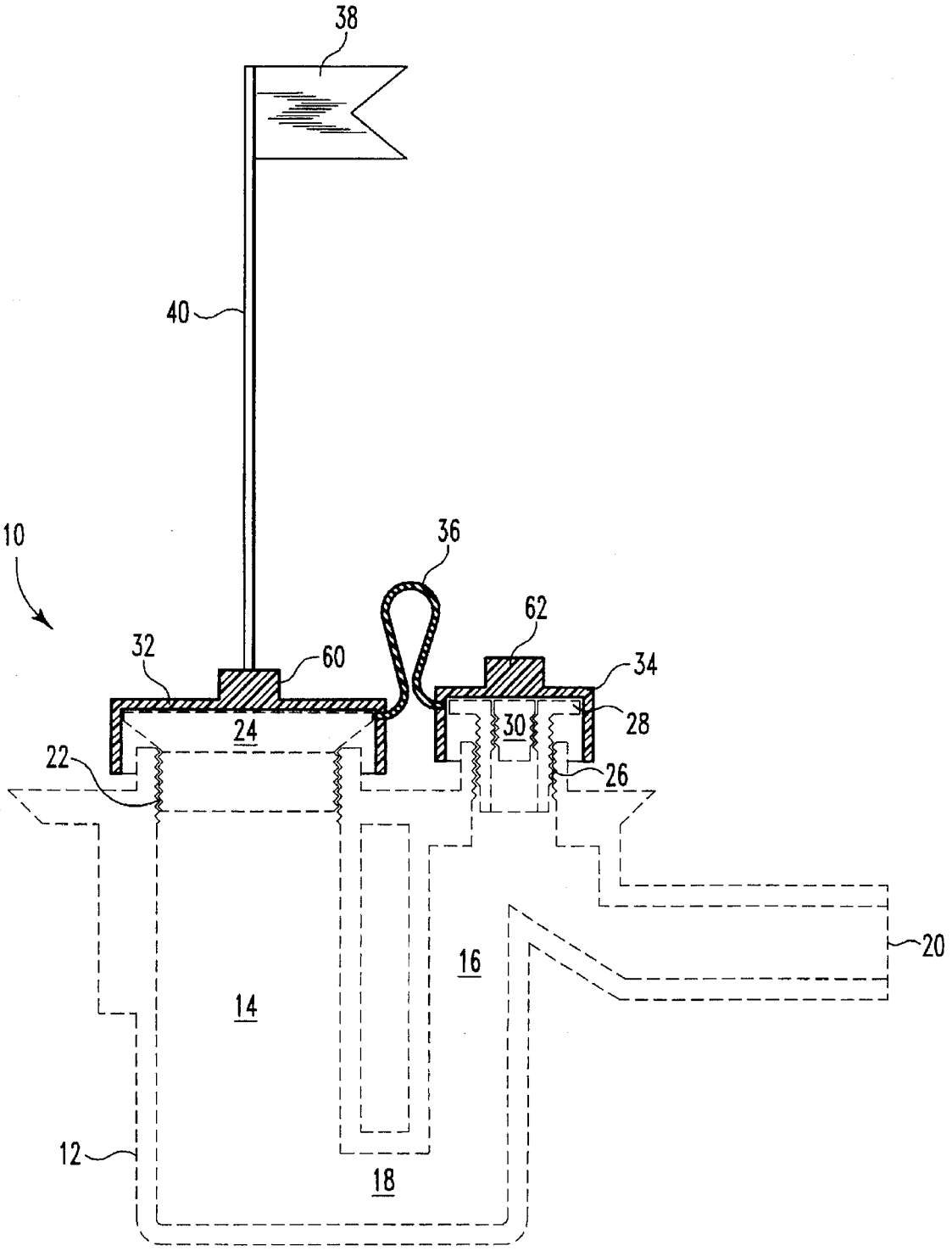
FIG. 1 is a cross-sectional view of a first embodiment of the present invention installed upon a floor drain.
Figure 2:
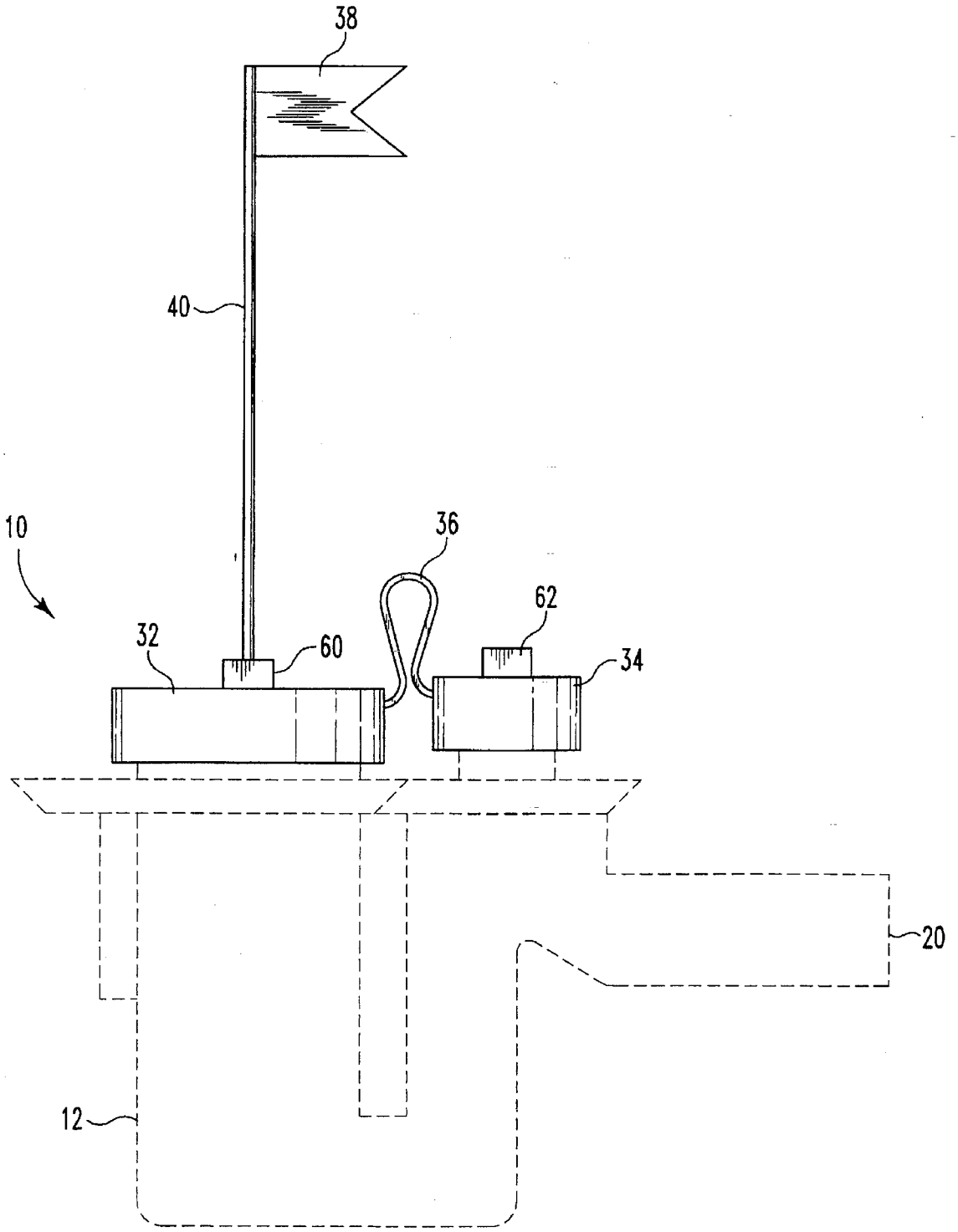
FIG. 2 is a right side elevational view of the first embodiment of the present invention installed upon a floor drain, which is a mirror image of its left side elevational view.
Figure 3:
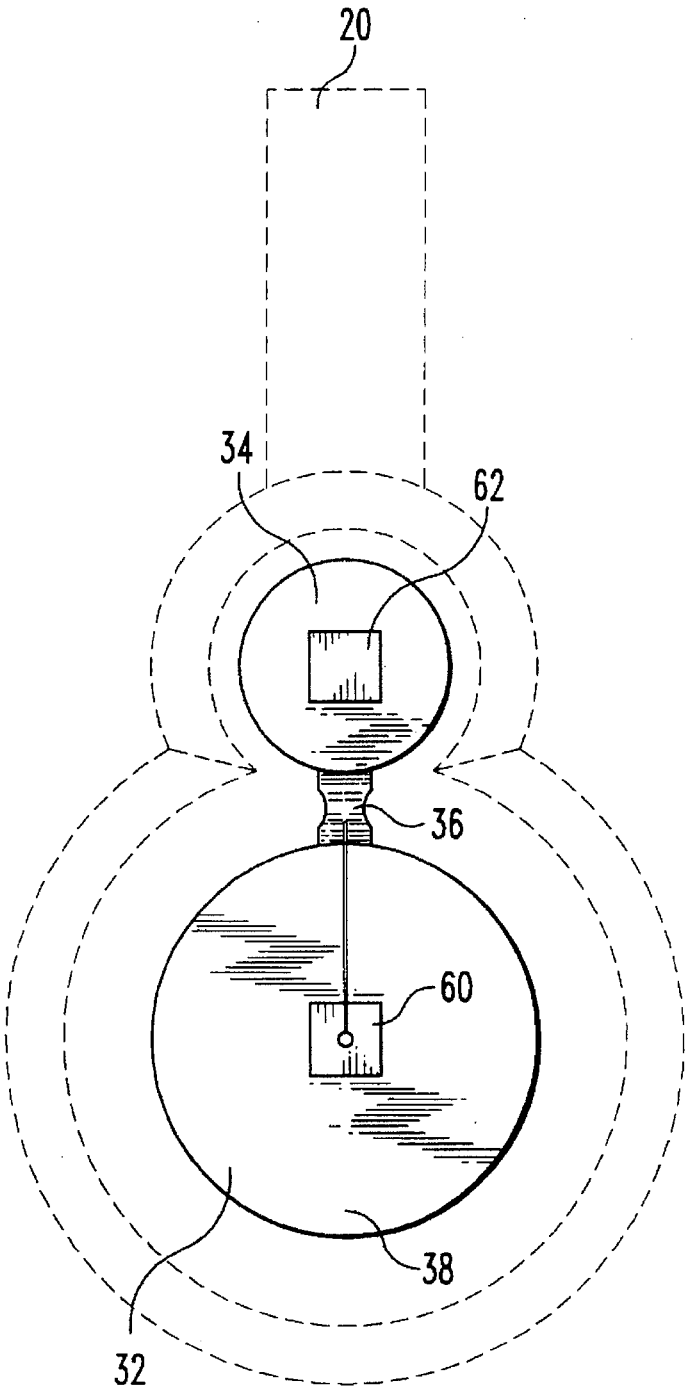
FIG. 3 is a top plan view of the first embodiment of the present invention installed upon a floor drain.
Figure 4:
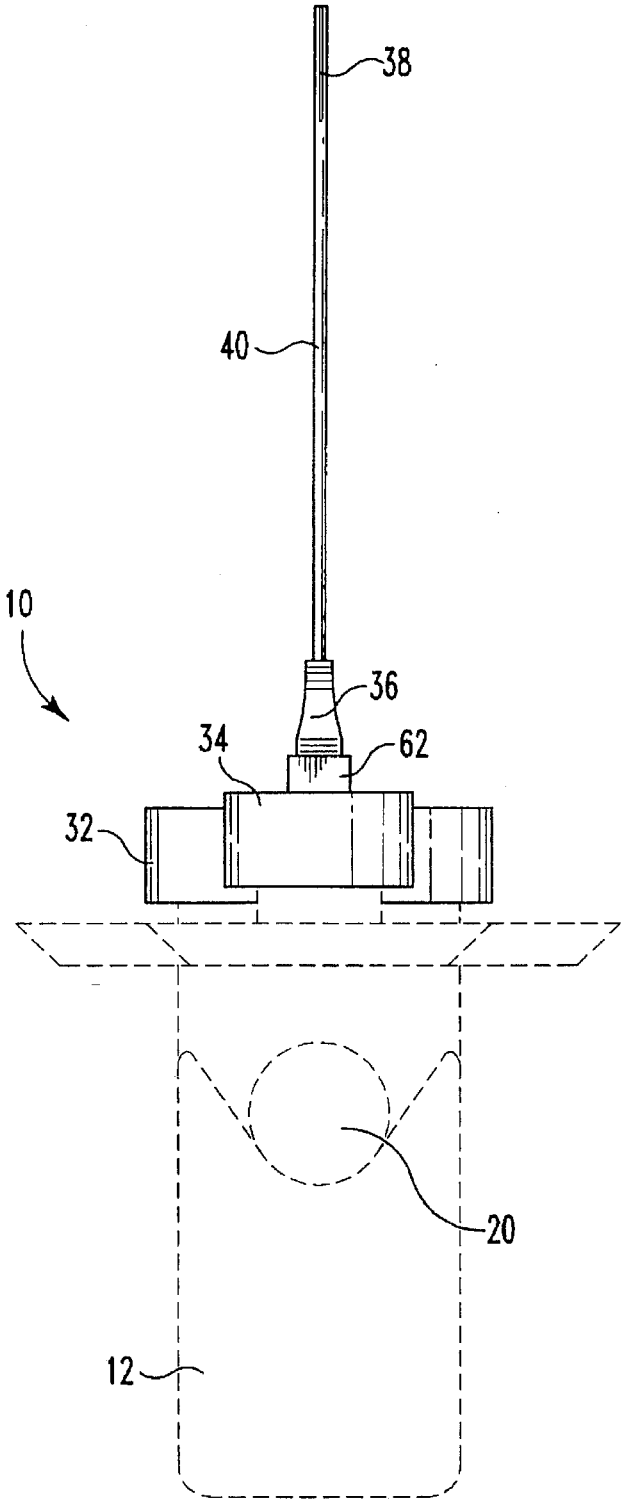
FIG. 4 is a front end elevational view of the first embodiment of the present invention installed on a floor drain.
Figure 5:
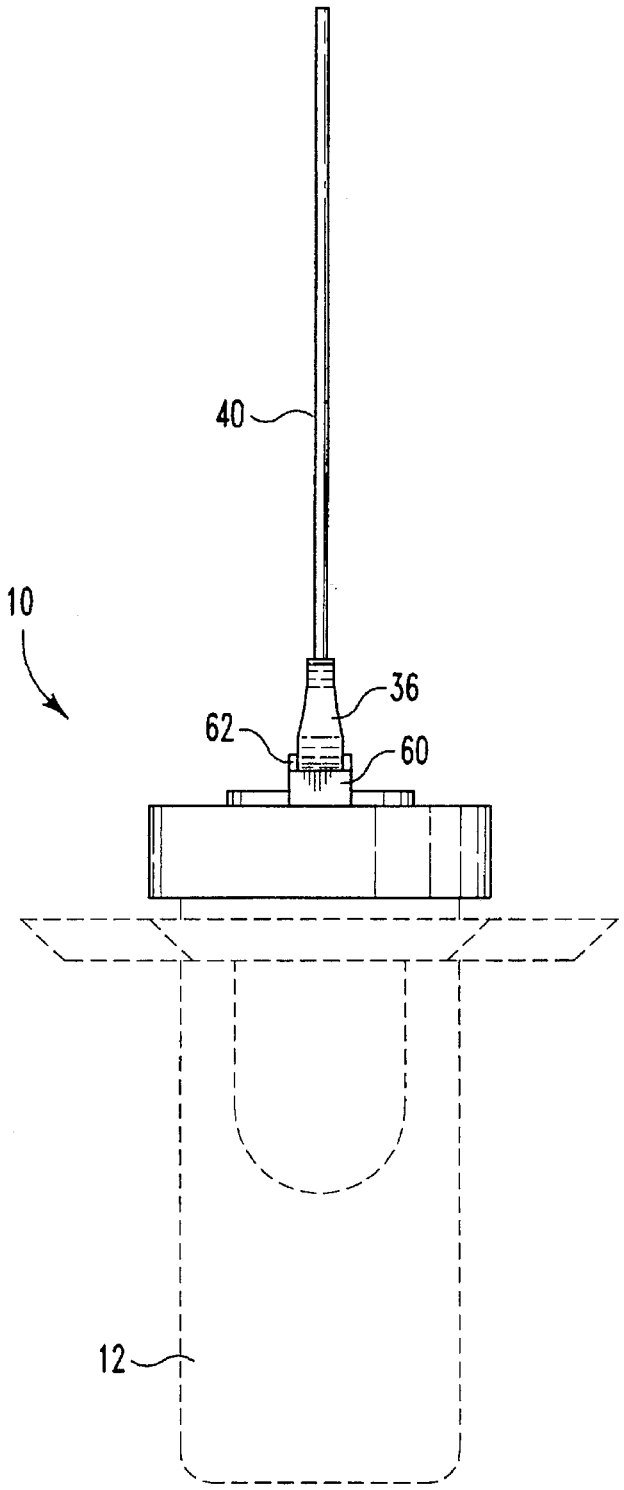
FIG. 5 is a back end elevational view of the first embodiment of the present invention installed on a floor drain.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

FIG. 1 illustrates a first embodiment of the drain and cleanout spacer of the present invention, indicated generally at 10. The spacer 10 is illustrated as being mounted upon a standard floor drain 12. The floor drain 12 includes a drainpipe 14 and a cleanout pipe 16 coupled by the shaft 18. An outlet 20 is provided for connection to other plumbing. The upper portion of the drain pipe 14 includes threads 22 which threadingly engage a drain strainer 24. Engagement of the dram strainer with the threads 22 enables vertical adjustment of the height of the drain strainer 24. Similarly, the top of the cleanout shaft 16 includes threads 26 which are threadingly engaged with a cleanout port closure 28. The threaded engagement between the cleanout port closure 28 and the threads 26 allows vertical adjustment of the height of the cleanout port closure 28. The cleanout port closure 28 includes a plug 30 which is threadingly engaged with the interior surface of the cleanout port closure 28. After the floor drain 12 is installed in the concrete slab floor, the plug 30 may be removed for access to the cleanout shaft 16. The floor drain 12 as thus described incorporates the features commonly found in such floor drains.

In order to protect the adjustable surfaces of the floor drain 12 when the concrete slab is being poured, the device 10 of the present invention includes a first spacer 32 and a second spacer 34. Both spacers 32 and 34 are preferably cup-shaped and define respective hollow cylindrical interior spaces. The interior dimension of the first spacer 32 is sized to be slightly larger than the external dimension of the drain strainer 24. In a preferred embodiment, the inside diameter of the first spacer 32 is one-quarter inch greater than the outside diameter of the drain strainer 24, thereby leaving a one-eighth inch annular clearance therearound. Similarly, the interior hollow cavity of the second spacer 34 is preferably one-quarter inch greater than the maximum outside dimension of the cleanout port closure 28. The sides of the first spacer 32 extend downward at least to the level of the uppermost threads 22. Similarly, the sides of the second spacer 34 extend downwardly at least to the level of the uppermost threads 26. The spacers 32 and 34 are preferably formed from a frangible material, such as plastic. This will allow the spacers to be easily broken away from the floor drain 12 after pouring of the concrete.

The first spacer 32 is preferably coupled to the second spacer 34 by means of a web 36. The web 36 is preferably formed of a resilient material, such as rubber. By coupling the first spacer 32 to the second spacer 34 by means of the web 36, upward movement of either spacer 32 or 34 under the influence of the flowing concrete is made much less likely due to the fact that the web 36 produces a downward moment on each of the spacers 32 and 34. Such downward moment counteracts any tendency of the spacers 32 and 34 to move in an upward direction in response to liquid concrete flowing therearound. The web 36 therefore helps to maintain proper placement of the spacers 32 and 34 during pouting of the concrete slab floor.

A further feature of the device 10 of the present invention is the incorporation of a flag 38 mounted to a pole 40 which is coupled to the first spacer 32 through the attachment block 60. The flag 38 signals the location of the device 10 so that it may be more really discerned while pouring the concrete slab, thereby reducing the chances that the device 10 will be completely submerged by the concrete. After the concrete slab has dried, the flag 38 further serves to warn workers of the location of the device 10 so that it is not inadvertently stepped upon or tripped over. A block 62 is additionally coupled to the top surface of the spacer 34.

In use, the floor drain 12 is installed by a plumber at its desired location prior to pouring of the concrete slab floor. The drain strainer 24 and cleanout port closure 28 are then adjusted to the approximate height of the finished floor. The first spacer 32 is then placed over the drain strainer 24 and the second spacer 34 is placed over the cleanout port closure 28. Furthermore, the web 36 reduces the likelihood that the spacers 32 and 34 will move upwardly when contacted by the flowing concrete. When the concrete is flowed for the slab floor, the lower extensions of the spacers 32 and 34 prevent the concrete from coming into contact with the drain strainer 24 or the cleanout port closure 28. Furthermore, the web 36 reduces the likelihood that the spacers 32 and 34 will move upwardly when contacted by the flowing concrete. Once the concrete has cured, the tops of the spacers 32 and 34 may be broken away by any convenient means, such as by breaking them into pieces with a hammer. The blocks 60 and 62 facilitate breaking of the spacers 32 and 34 without damaging the drain strainer 24 or the cleanout port closure 26. The downward extending portions of the spacers 32 and 34 remain attached to the surrounding concrete, thereby leaving approximately a one-eighth inch annular spacing around the perimeter of the drain strainer 24 and the cleanout port closure 28. This annular spacing allows final adjustment of the vertical height of the drain strainer 24 and the cleanout port closure 28 in order to bring them into alignment with the surface of the slab floor. Once this adjustment has been made, the small annular space therearound may easily be filled with a caulking compound.

It will be appreciated by those skilled in the art that the drain and cleanout spacer 10 of the present invention incorporates many desirable features. First, the device 10 includes a separate spacer for both the drain strainer 24 and the cleanout port closure 28. The configuration and sizing of these spacers enables a very small annular space to be maintained around the protected devices, which is easily caulked once the floor has been poured. The device 10 further includes the resilient web 36 which produces forces that tend to maintain correct positioning of the spacers 32 and 34 as the liquid concrete flows therearound. Such proper positioning is critical in order to prevent the liquid concrete from flowing under the spacers 32 or 34 and thereby seizing the drain strainer 24 and/or cleanout port closure 28. Finally, the incorporation of the flag 38 provides an easily spotted visual indication of the location of the device 10, thereby lowering the likelihood that the device 10 would be completely covered by the flowing concrete or later stepped upon inadvertently by a worker.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A drain and cleanout spacer, comprising:

a first spacer having a round first top section and a hollow cylindrical first rim section coupled circumferentially to the first top section, wherein the first top section and the first rim section together form a first cylindrical space;

a second spacer having a round second top section and a hollow cylindrical second rim section coupled circumferentially to the second top section, wherein the second top section and the second rim section together form a second cylindrical space; and a flexible web coupling the first and second spacers: and maintaining proper placement of the spacers on a drain and a cleanout port, respectively, during the pouring of concrete wherein the first and second spacers are formed from a frangible material and;

wherein the first and second spacers are adapted to be removed from said drain and said cleanout port, respectively, after concrete has cured around them, by breaking them into pieces.

2. The drain and cleanout spacer of claim 1, further comprising:

an elongate pole coupled to one of the first and second top section; and a flag coupled to the elongate pole, wherein the flag is operable to signal a location of the drain and cleanout spacer.

3. The drain and cleanout spacer of claim 1, wherein the flexible web is constructed of rubber.

4. The drain and cleanout spacer of claim 1, wherein the first and second spacers are constructed of plastic.

* * * * *

UNITED STATES PATENT AND TRADEMARK OFFICE

CERTIFICATE OF CORRECTION

PATENT NO. : 5,623,971

DATED : April 29, 1997

INVENTOR(S) : William E. Foernzler

It is certified that error appears in the above-indentified patent and that said Letters Patent is hereby corrected as shown below:

In column 1, line 13, please delete "restall" and insert therefor —install—.

In column 1, line 37, please delete "dram" and insert therefor —drain—.

In column 1, line 40, please delete "dram" and insert therefor —drain—.
In column 1, line 50, please delete "slab. but" and insert therefor —slab, but—.

In column 2, line 22, please delete "whereto" and insert therefor —wherein—.
In column 2, line 28, please delete "dram" and insert therefor —drain—.

In column 2, line 43, please delete "pouting" and insert therefor —pouring—.

UNITED STATES PATENT AND TRADEMARK OFFICE

CERTIFICATE OF CORRECTION

PATENT NO. : 5,623,971

DATED : April 29, 1997

INVENTOR(S) : William E. Foernzler

It is certified that error appears in the above-indentified patent and that said Letters Patent is hereby corrected as shown below:

In column 2, line 49, please delete "dram" and insert therefor —drain—.
In column 3, line 21, please delete "dram" and insert therefor —drain—.
In column 3, line 67, please delete "pouting" and insert therefor —pouring—.
In column 4, line 5, please delete "really" and insert therefor —readily—.
In column 4, line 31, please delete "26." and insert therefor —28.—.

In the Abstract, line 34, please delete "dram" and insert -- drain --.

Signed and Sealed this

Eleventh Day of November, 1997

*Attest:*

*Attesting Officer*

Bruce Lehman

BRUCE LEHMAN

*Commissioner of Patents and Trademarks*